US007353547B2

(12) United States Patent
Diethelm et al.

(10) Patent No.: US 7,353,547 B2
(45) Date of Patent: Apr. 8, 2008

(54) DISCHARGE VALVE FOR A FLUSHING CISTERN

(75) Inventors: Alois Diethelm, Vorderthal (CH); Reto Tremp, Uznach (CH)

(73) Assignee: Geberit Technik AG, Jona (CH)

( * ) Notice: Subject to any disclaimer, the term of this patent is extended or adjusted under 35 U.S.C. 154(b) by 0 days.

(21) Appl. No.: 11/418,116

(22) Filed: May 5, 2006

(65) Prior Publication Data

US 2006/0248638 A1 Nov. 9, 2006

(30) Foreign Application Priority Data

May 6, 2005 (EP) ..... 05405339

(51) Int. Cl.
*E03D 1/34* (2006.01)

(52) U.S. Cl. ..... 4/378

(58) Field of Classification Search ..... 4/378, 4/379, 381, 382, 384–388
See application file for complete search history.

(56) References Cited

U.S. PATENT DOCUMENTS 4,557,000 A * 12/1985 Strangfeld ..... 4/324

FOREIGN PATENT DOCUMENTS

| | | |
|---|---|---|
| DE | 34 00 800 A1 | 6/1985 |
| DE | 92 15 972 U1 | 4/1994 |
| EP | 0 722 020 A1 | 7/1996 |
| EP | 1 270 831 A2 | 1/2003 |

* cited by examiner

*Primary Examiner*—Huyen Le
(74) *Attorney, Agent, or Firm*—Sughrue Mion, PLLC

(57) ABSTRACT

The discharge valve for a flushing cistern (1) has a main valve (V) with a main valve body (3) which forms a piston above which a relief chamber (4) is arranged. By means of a first auxiliary valve (HV1), the relief chamber (4) can be emptied, at least in part, in order to trigger flushing. By means of a second auxiliary valve (HV2), the relief chamber (4) can be flooded in order to interrupt flushing. The first auxiliary valve (HV1) and the second auxiliary valve (HV2) have a common auxiliary valve body (7) which, when flushing is triggered, releases the valve opening (68) of the first auxiliary valve (HV1) and closes the valve opening (6) of the second auxiliary valve (HV2). A valve seat (18) of the first auxiliary valve (HV1) and a valve seat (21) of the second auxiliary valve (HV2) are preferably arranged on the main valve body. The discharge valve can be actuated with a comparatively small actuating force and small actuating distance and allows a very compact construction with a comparatively small number of components.

11 Claims, 7 Drawing Sheets

DISCHARGE VALVE FOR A FLUSHING CISTERN

Figure 1:
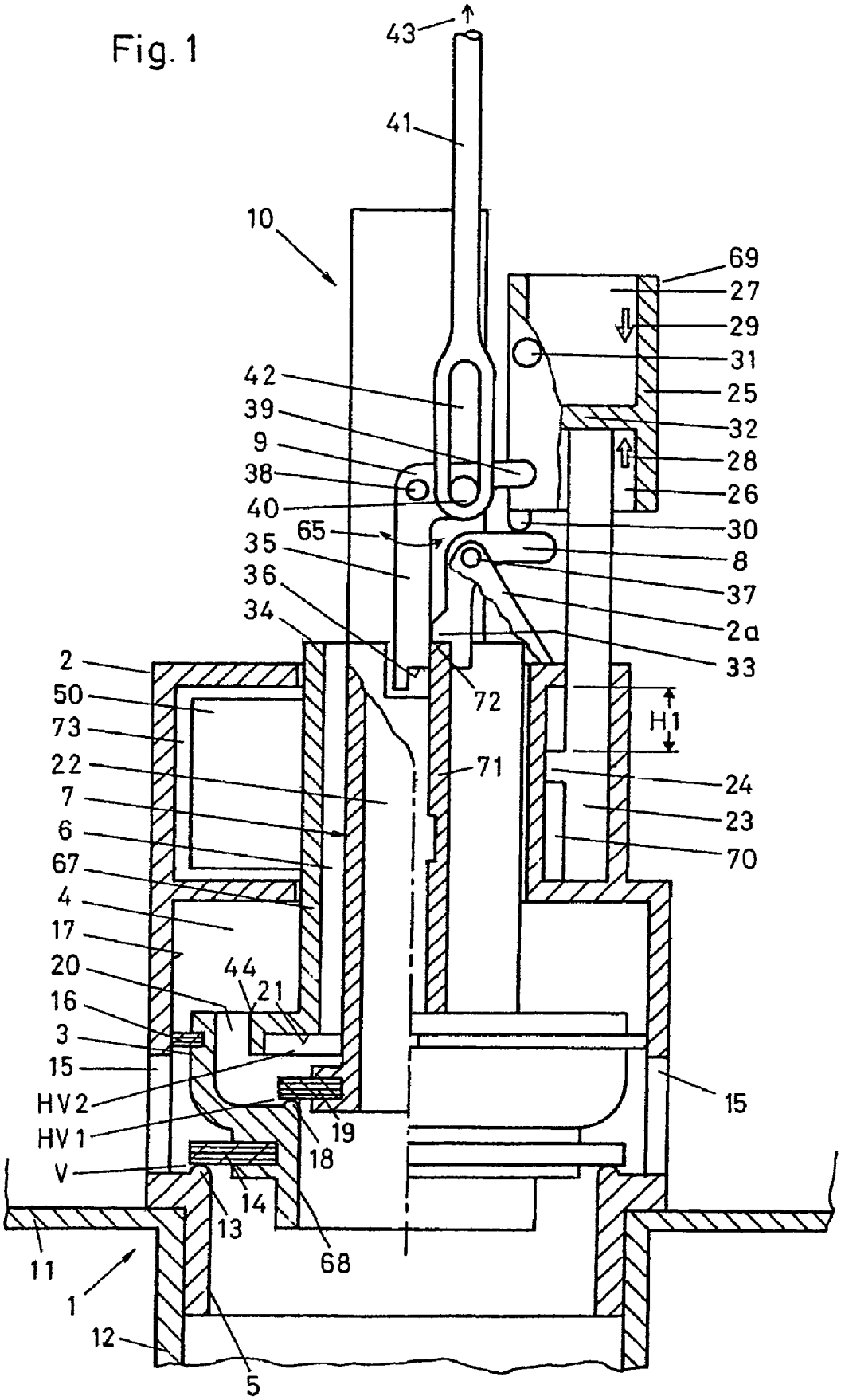

The invention relates to a discharge valve for a flushing cistern, having a main valve which, in a valve housing, has a main valve body which forms a piston above which a relief chamber is arranged, having a first auxiliary valve, by means of which the relief chamber can be emptied, at least in part, in order to trigger flushing, and having a second auxiliary valve, by means of which the relief chamber can be flooded in order to interrupt flushing.

Discharge valves for flushing cisterns have been known for a long time now. In particular discharge valves which allow partial flushing with, for example, three liters of flushing water have proven successful. In the case of such a flushing cistern, it is possible to select between the options of full flushing or partial flushing. Two flushing-triggering buttons are usually provided for this purpose. One button is pushed to trigger partial flushing and the other button is pushed to trigger full flushing.

A discharge valve which allows such two-stage flushing has been disclosed in EP 0 722 020 B. In the case of this discharge valve, the valve body is raised in order to trigger flushing. In the case of partial flushing, a float controls a lever which prematurely releases the valve body, with the result that the latter drops onto the valve seat before the flushing cistern is emptied. This discharge valve has frequently proven successful in practice. The discharge valve has the advantage that it may be of very compact construction. The actuating force and the actuating distance for the operations of opening and closing the valve, however, are comparatively large.

DE 92 15 972 U discloses a discharge valve of the generic type in which flushing is intended to be triggered with a smaller actuating force. The discharge valve has a main valve body which, by virtue of an auxiliary valve being actuated by an actuating means, can be raised up from its seat on account of a negative water balance forming in a relief chamber. When the relief chamber is emptied, a negative pressure forms in it and raises the main valve body in the manner of a piston. An additional auxiliary valve is provided for optional partial emptying, it being possible for this additional auxiliary valve to be opened, at least briefly, in order to flood the relief chamber. When the relief chamber is flooded, a positive water balance forms, as a result of which the main valve body closes prematurely. The additional auxiliary valve is assigned a float for partial emptying purposes. The auxiliary valve has an auxiliary valve body which can be moved downwards in order to trigger flushing. A spring is subjected to stressing here. This discharge valve comprises a comparatively large number of individual parts and requires a comparatively large installation volume, which is disadvantageous in the case of flush-mounted flushing cisterns in particular.

EP 1 270 831 has disclosed a discharge valve which likewise has an auxiliary valve and allows a triggering operation with a comparatively small actuating force. The operations of both opening and closing the auxiliary valve are float-controlled. Closure of the valve takes place with delayed action, which is disadvantageous.

The object of the invention is to provide a discharge valve of the abovementioned type which allows partial flushing and can be opened and closed with the smallest possible actuating force and a small actuating distance and can nevertheless be of compact construction and of comparatively small volume. The discharge valve, in addition, is to be functionally reliable.

The object is achieved, in the case of a discharge valve of the generic type, in that the first and the second auxiliary valves have a common auxiliary valve body which, when flushing is triggered, releases the valve opening of the first auxiliary valve and closes the valve opening of the second auxiliary valve.

In the case of the discharge valve according to the invention, there is no need for a separate additional auxiliary valve with a corresponding second auxiliary valve body. The auxiliary valve by means of which the relief chamber is emptied, at least in part, and the second auxiliary valve, by means of which the relief chamber is flooded, are operated by the same auxiliary valve body. The movement of the auxiliary valve body by means of which the valve opening of the first auxiliary valve is released also closes the valve opening of the second auxiliary valve. The operations of opening the valve opening of the first auxiliary valve and of closing the valve opening of the second auxiliary valve can take place with a comparatively short displacement action of the auxiliary valve body and thus with a comparatively short actuating distance. This allows a significantly more straightforward and compact construction of the discharge valve. On account of the small actuating force and of the short actuating distance, the discharge valve is particularly suitable for motor actuation.

A particularly compact construction is achieved if, according to a development of the invention, the valve opening of the first auxiliary valve and the valve opening of the second auxiliary valve are arranged on the main valve body. It is thus possible, in addition, for the number of individual parts to be reduced to a significant extent.

An even more straightforward construction is achieved if, according to a development of the invention, the auxiliary valve body can be moved vertically between the valve opening of the first auxiliary valve and the valve opening of the second auxiliary valve. The two auxiliary valve openings are preferably arranged directly one above the other. A comparatively small vertical movement of the auxiliary valve body can open the first auxiliary valve and close the second auxiliary valve. A particularly short actuating distance is thus possible.

It is preferable for the first auxiliary valve to be opened by virtue of the auxiliary valve body being raised and for the valve opening of the second auxiliary valve body to be closed with the same displacement action.

According to a development of the invention, provision is made for the main valve body, in its basic position, to be held down by a first catch, and for this catch to be pivoted, when flushing is triggered, such that it releases the main valve body.

According to a development of the invention, provision is made for a second catch to be arranged on the auxiliary valve body, the auxiliary valve body being connected to the main valve body by means of this second catch. This allows particularly functionally reliable opening of the valve opening of the first auxiliary valve.

According to a development of the invention, in order to trigger partial flushing, provision is made for the second catch to interact with a float which releases the auxiliary valve body when a predetermined flushing-water level is reached.

Particularly cost-effective production and a compact construction are achieved if, according to a development of the invention, the valve opening of the first auxiliary valve and the valve opening of the second auxiliary valve are arranged on the main valve body.

Further advantageous features can be gathered from the dependent patent claims, from the following description and from the drawing.

Figure 2:
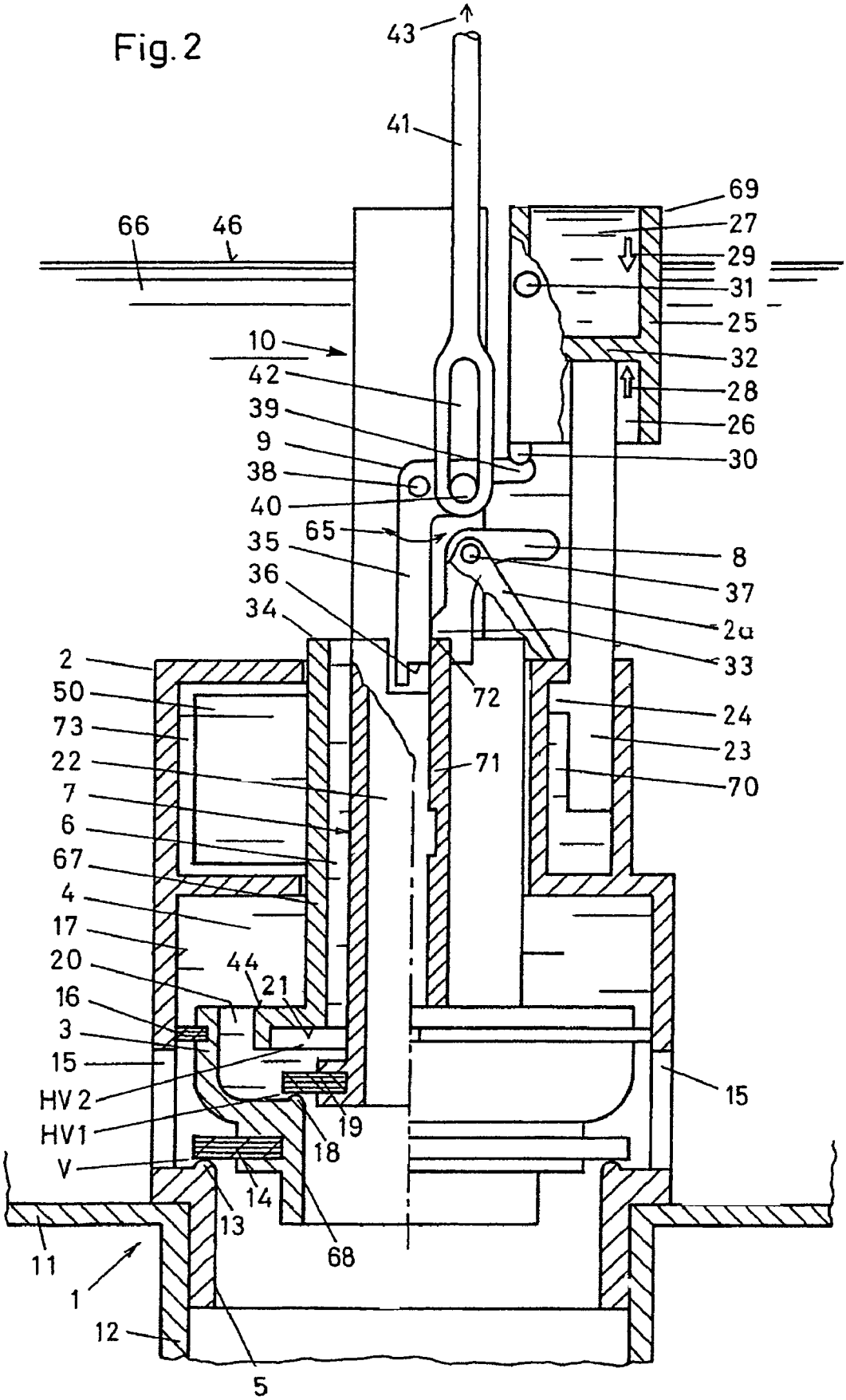
Figure 3:
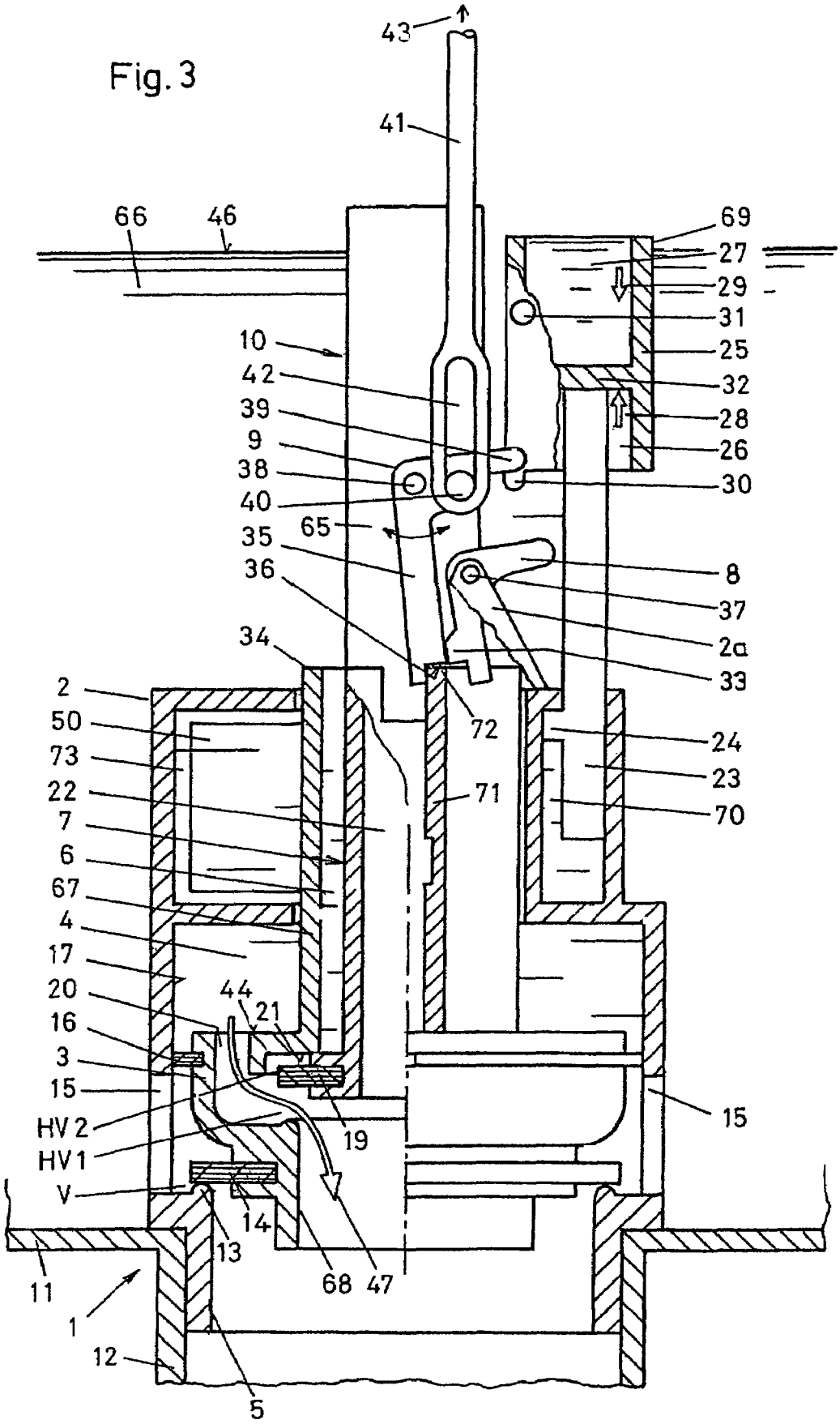
Figure 4:
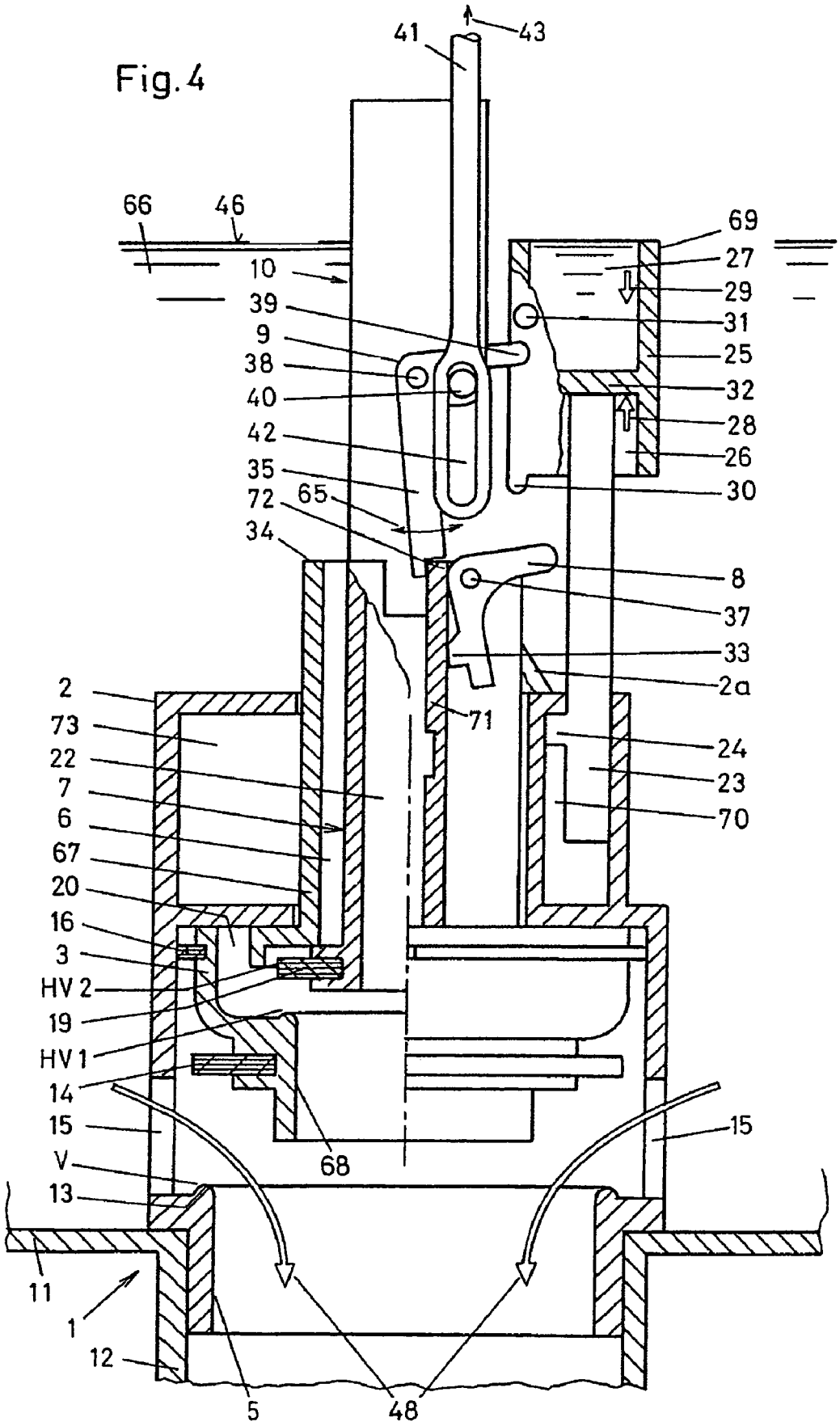
Figure 5:
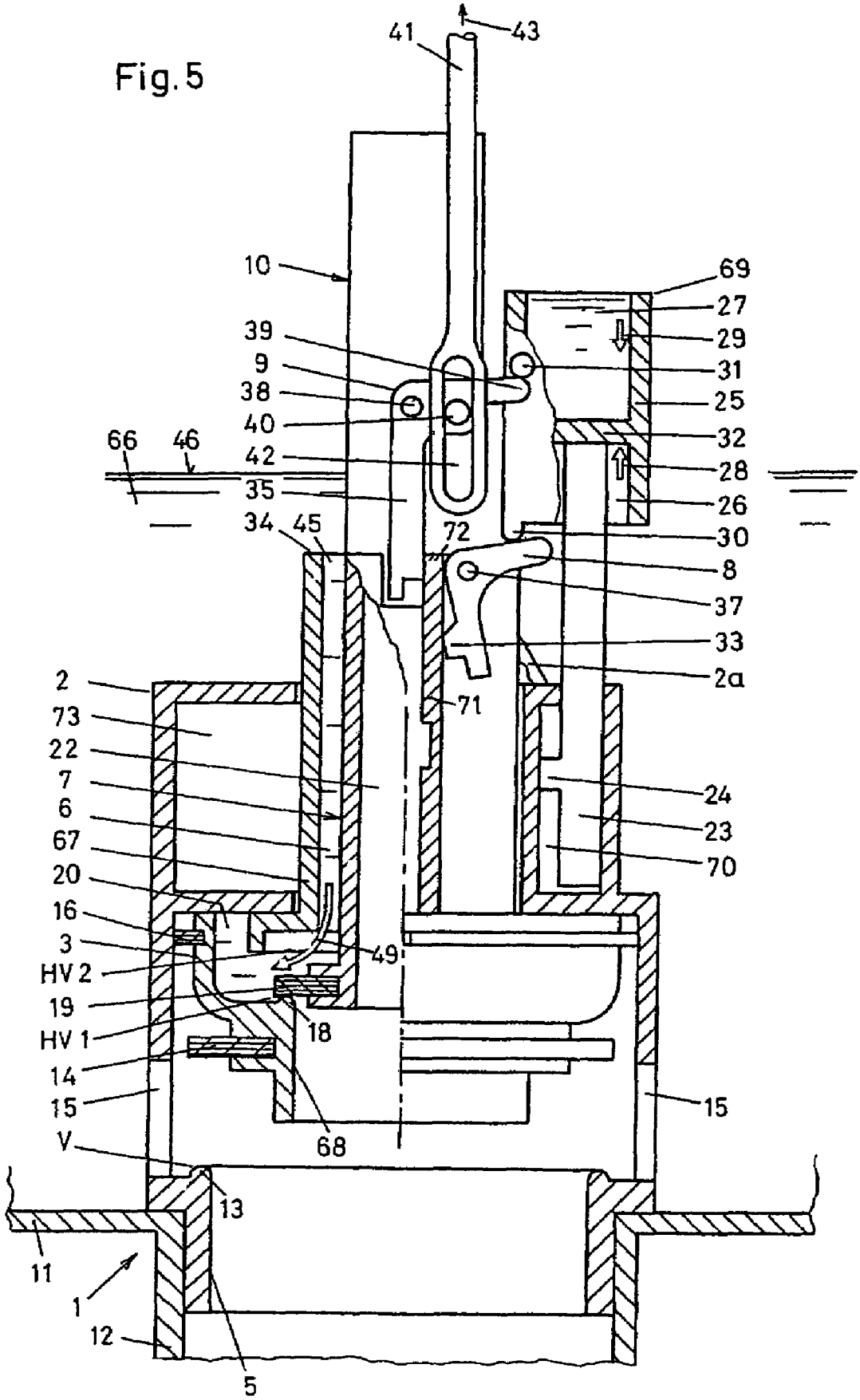
Figure 6:
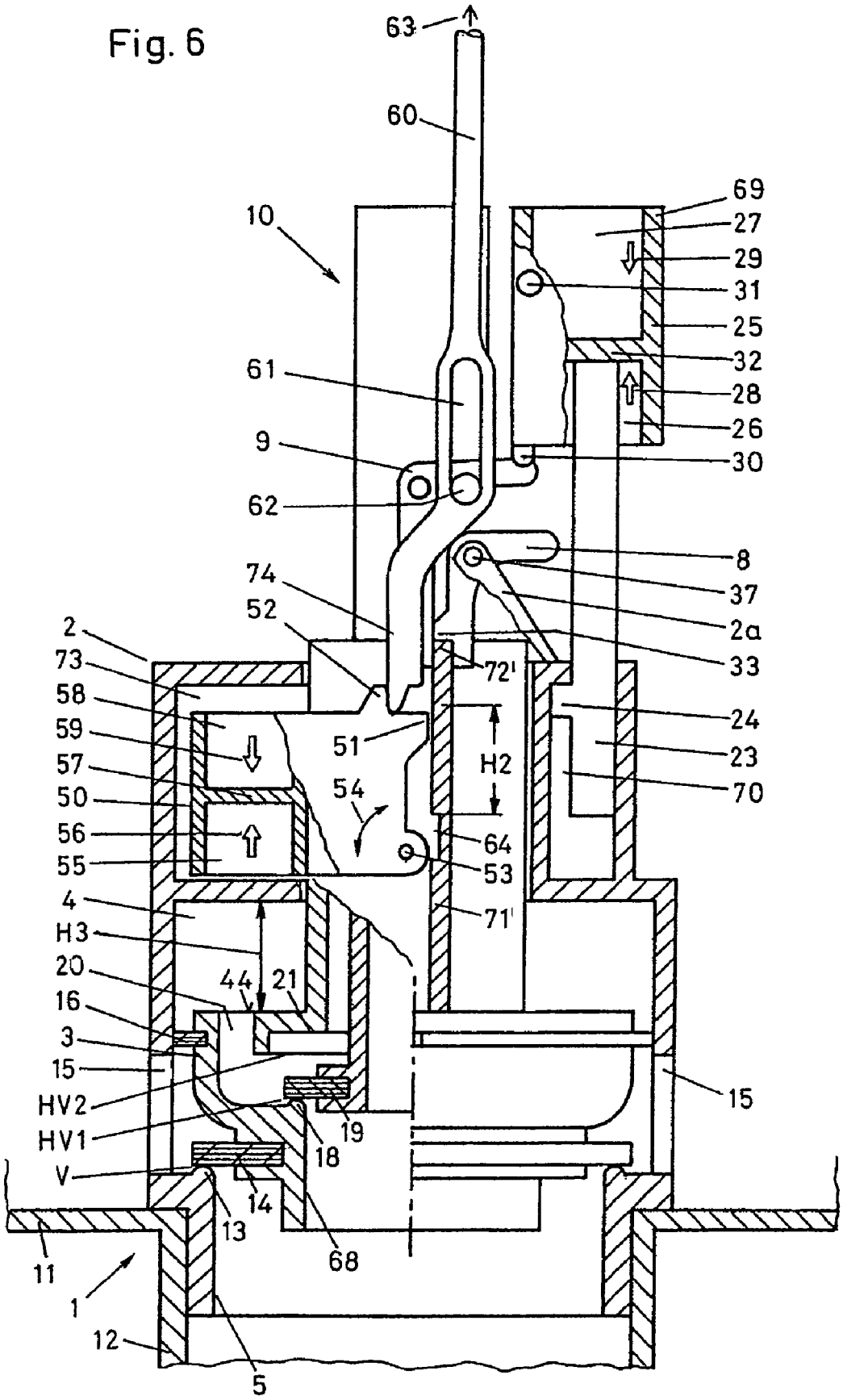
Figure 7:
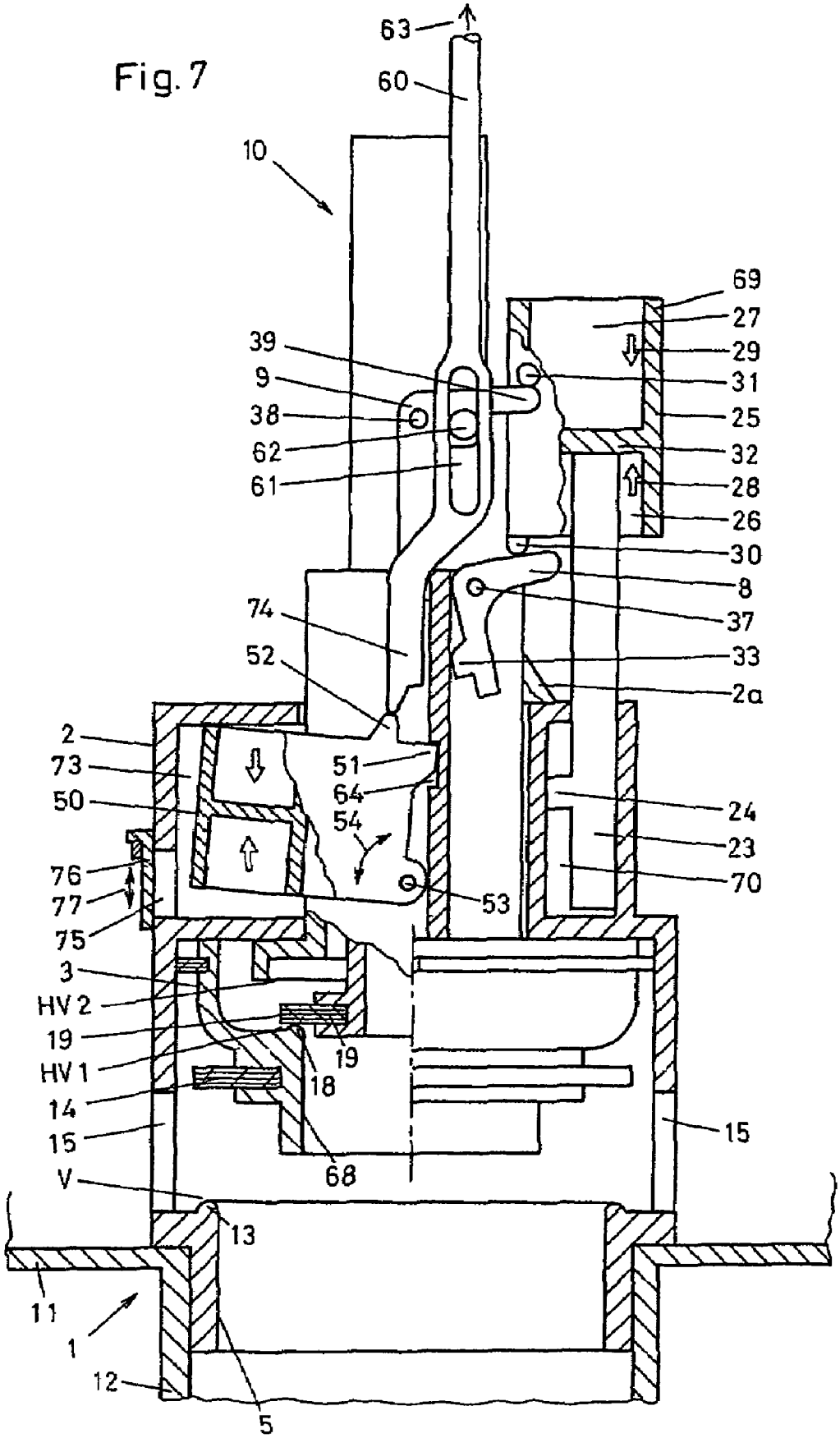

An exemplary embodiment of the invention is explained in more detail hereinbelow with reference to the drawing, in which:

FIG. 1 shows, schematically, a section through a discharge valve according to the invention in a flushing cistern which is merely shown in part here, certain individual parts having been omitted for illustrative reasons, FIG. 2 shows a view according to FIG. 1, the flushing cistern having been filled with water, FIG. 3 shows a section through the discharge valve immediately following opening of the first auxiliary valve and closure of the second auxiliary valve, FIG. 4 shows a section through the discharge valve with the main valve open, FIG. 5 shows a section through the discharge valve immediately prior to flushing being interrupted following partial flushing, FIG. 6 shows a further section through the discharge valve for the purpose of explaining full flushing, and FIG. 7 shows a section according to FIG. 6, the main valve being open and full flushing having been triggered.

FIG. 1 shows part of a flushing cistern 1 which may be designed in the conventional manner and has an actuating device (not shown here). The flushing cistern 1 has, on a base 11, a conventional drainage connector 12, into which a discharge valve 10 is inserted. According to FIG. 2, flushing water 66 is stored in the flushing cistern 1. The volume of flushing water 66 is, for example when the flushing cistern 1 is full, six or nine liters. FIG. 2 shows the water surface 46 with the flushing cistern 1 filled. The discharge valve 10 serves for emptying the flushing cistern 1, the valve being opened, for example, for actuating a button (not shown here) and flushing water flowing through the outlet connector 12 into a WC bowl (not shown here). Flushing is triggered, as has been mentioned, for example by virtue of a button being actuated. However, contactless motor actuation is also conceivable in principle.

The discharge valve 10 has a valve housing 2 which has a valve opening 5. Arranged above this valve opening 5, in a valve housing 2, are a plurality of lateral openings 15, through which flushing water 66 can flow, when the valve opening 5 is open, into the outlet connector 12 and thus into the WC bowl.

The valve opening 5 forms, with a main valve body 3, a main valve V. The main valve body 3 has a valve disc 14, which in FIG. 1 rests on a valve seat 13. The main valve V is closed in FIGS. 1 to 3.

The valve body 3 has, around it circumference, a piston ring 16 which butts with sealing action, and such that it can be displaced vertically, against an inner side 17 of a relief chamber 4. The main valve body 3 uses the sealing ring 16 to seal the relief chamber 4 in the downward direction. It forms a piston which is movable vertically to a limited extent with the displacement action H3 shown in FIG. 6, between the bottom position, which is shown in FIG. 1, and a top position, which is shown in FIG. 4.

Mounted on the main valve body 3 is an auxiliary valve body 7 which, in FIG. 1, rests on a valve seat 18 of a first auxiliary valve HV1. A second valve seat 21 of a second auxiliary valve HV2 is arranged above this valve seat 18. This second valve seat 21 is formed by a tube 67 which is integrally formed on the main valve body 3 by way of crosspieces (not shown here) and has a top periphery 34. The tube 67 is open at a top edge 34 and has a channel 6 which, at a bottom end, forms the valve opening of the second auxiliary valve HV2. The auxiliary valve body 3 is thus the common valve body for the first auxiliary valve HV1 and the second auxiliary valve HV2. The auxiliary valve body 7 has a valve disc 19 which, when the auxiliary valve HV1 is closed, rests on a valve seat 18. In FIG. 1, the first auxiliary valve HV1 is closed and the second auxiliary valve HV2 is open. The auxiliary valve body 7 can be moved with a comparatively short displacement action between the bottom position, which is shown in FIG. 1, and the top position, which is shown in FIG. 3. This displacement action is significantly shorter than the displacement action H3 of the main valve body 3. In addition, the force which is necessary for raising the auxiliary valve body 7 is comparatively small. In the position which is shown in FIG. 3, the second auxiliary valve HV2 is closed, but the first auxiliary valve HV1 is open.

The main valve body 3 has, on a top side 44, at least one control opening 20, which is open in the direction of the relief chamber 4 and, when the first auxiliary valve HV1 is open, connects the relief chamber 4 to an opening 68 of the first auxiliary valve HV1. This opening 68 leads into the main valve opening 5. When the first auxiliary valve HV1 is open, water which is present in the relief chamber 4 can flow out through the control opening 20 into the opening 68 and thus into the outlet connector 12.

When the main valve V is closed, the tube 67 of the main valve body 3 projects beyond the valve housing 2, as FIG. 1 shows. The auxiliary valve body 7 is mounted in this tube 67. This auxiliary valve body 7 likewise projects beyond the valve housing 2, by way of a top end, and has an overflow channel 22. In this case, the auxiliary valve body 7 forms an overflow pipe which determines the maximum filling of the flushing cistern 1. However, it is also possible for the overflow channel 22 to be arranged, in a manner known per se, outside the discharge valve 10. The auxiliary valve body 7 is thus not necessarily an, overflow pipe.

A float 69 is mounted on the valve housing 2, this float forming, in a housing 25, an air chamber 26 and a water chamber 27. These two chambers 26 and 27 are separated from one another by a base wall 32. Even with the flushing cistern filled, there is always air in the air chamber 26 and water in the water chamber 27. The air in the air chamber 26 causes a buoyancy force in the direction of arrow 28, and the water in the water chamber 27, in the case of partial emptying of the flushing cistern (FIG. 5), causes a weight in the direction of arrow 29. A rod 23 is fastened on the float 69 and projects downwards into a chamber 70 of the valve housing 2. A stopping protuberance 24 is integrally formed on the rod 23 and allows a maximum displacement action H1. FIG. 1 shows the float 69 in the bottom position. Starting from this position, the float 69 can be raised, with the displacement action H1, by the buoyancy force of the air chamber 26.

The float 69 has a protuberance 30 by means of which, according to FIG. 1, with the flushing cistern 1 empty or partially empty, the float 69 bears on a first two-armed catch 8. The catch 8 is connected to the valve housing 2 such that it can be pivoted on the valve-housing part 2*a*, and it engages around the tube 67 in a semicircular manner. The catch 8 has two protuberances 33, which interact with the main valve body 3. For this purpose, the main valve body 3 has, on its outside, two vertically running ribs 71 and 71' located opposite one another (FIG. 6), these ribs having a top periphery 72, 72', respectively, against which a respective protuberance 33 butts according to FIG. 1. In that position of the first catch 8 which is shown in FIG. 1, the two protuberances 33 lock the main valve body 3 in the closed position shown. The main valve body 3 thus cannot be raised. The weight of the float 69 causes the first catch 8 to be retained in the position shown. If the flushing cistern 1 is filled with flushing water 66 according to FIG. 2, then the float 69 is raised, as shown, into the uppermost position and the catch 8 is thus relieved of the weight of the float 69. When the flushing cistern 1 is emptied, the float 69 descends downwards again and bears on the first catch 8 by way of the protuberance 30.

A second, likewise two-armed catch 9 which can be pivoted in the directions of the double arrow 65 is mounted on the auxiliary valve body 7, this catch engaging around the auxiliary valve body 7 in a semicircular manner and being connected thereto via a rotary articulation 38. Arranged on two horizontal arms 39 of the catch 9 is a respective driver 40, 62, on which a respective connecting rod 41, 60 (FIG. 6) acts. The drivers 40 and 62 each form a pin which engages in a slot 42 of the respective connecting rod 41, 60. The connecting rod 41, 60 may be raised by an actuating means (not shown here), for example by an actuating lever, in the direction of the respective arrow 43, 63. Arranged on a downwardly directed arm 35 is a shoulder 36 which, with the auxiliary valve body 7 raised, rests on the periphery 72 or 72' of the respective rib 71, 71' instead of the protuberances 33, as FIG. 3 shows. If the connecting rod 41 or 60 is pulled, then it subjects the second catch 9 to a torque which acts in the anticlockwise direction in respect of the rotary articulation 38 in FIG. 1. By virtue of this torque, when the auxiliary valve body 7 is raised, the first catch 8 is rotated in the anticlockwise direction about the rotary articulation 37 and the two protuberances 33 are thus pushed away from the periphery 72. With the auxiliary valve body 7 raised, the main valve body 3 is thus locked with the auxiliary valve body 7.

Arranged above the relief chamber 4 is a further chamber 73 which, according to FIG. 7, has an opening 75 which can be closed by a slide 76. This chamber 73, according to FIGS. 6 and 7, contains a float 50 which is mounted on the valve housing 2 such that it can be pivoted about a rotary articulation 53. The float 50 is a so-called tilting-action float and has a bottom air chamber 55 and a top water chamber 58. The chambers 55 and 58 are separated from one another by a base wall 57. With the flushing cistern filled according to FIG. 2, the chamber 73 is filled with water. The air in the air chamber 55 gives rise to a buoyancy force in the direction of arrow 56, and the water in the water chamber 58, with chamber 73 empty, gives rise to a weight in the direction of the arrow 59. With the chamber 73 filled, the float 50 is subjected to a torque in the clockwise direction in accordance with double arrow 54.

A forwardly projecting nose 51 and an upwardly projecting stopping protuberance 52 are arranged on the float 50. The stopping protuberance 52 interacts with the second connecting rod 60. This connecting rod 60 is provided for full flushing and can be raised in the direction of the arrow 63. The second connecting rod 60 has a slot 61 in which the driver 62 of the second catch 9 engages. If the connecting rod 60 is raised in the direction of the arrow 63, then the connecting rod 60 acts on the driver 62 and thus pulls the auxiliary valve body 7 upwards. As with the raising operation using the connecting rod 41, the catch 9 is subjected to a torque in the anticlockwise direction about the rotary articulation 38 according to FIG. 6, by means of which the catch 8 is pivoted. The catch 8 rests simultaneously on the rib 71 and on the second rib 71' located opposite. The rib 71' likewise has a top periphery 72', on which the catch 8 rests. The first catch 8 and the second catch 9 thus extend in an arcuate manner around the auxiliary valve body 7. FIG. 1 shows one side and FIG. 6 shows the other side.

If the second connecting rod 60 is raised, then the tongue 74 which is integrally formed at the bottom end of the second connecting rod 60 is raised at the same time. In the basic position, this tongue 74, according to FIG. 6, butts against the stopping protuberance 52 and thus prevents the float 50 from tilting about the rotary articulation 53. When the second connecting rod 60 is raised, the tongue 74, according to FIG. 7, is raised above the stopping protuberance 52 and the float 50 is thus freed and can pivot about the rotary articulation 53 in the clockwise direction on account of the abovementioned torque. The nose 51 thus comes into engagement with a recess 64 of the rib 71'. This causes the raised main valve body 3 to be locked. The float 50 remains in this position as long as there is water in the chamber 73 and the abovementioned torque is thus active.

The action of the water flowing out of the chamber 73 can be regulated by the slide 76 which is shown in FIG. 7. This slide 76 is located in front of the opening 75 and can be displaced in the directions of the double arrow 77. If the slide 76 is in a position which is shown in FIG. 7, then the opening 75 is closed. If the level of the flushing water 66 drops below the level of the opening 75, then the water remains in the chamber 73 until the flushing cistern 1 has essentially been emptied. With the slide 76 raised, the chamber 73 empties comparatively quickly, however, with the result that the chamber 73 is emptied before the flushing cistern 1 has been emptied. Once the chamber 73 has been emptied, the abovementioned torque is no longer present and the float 50, on account of its weight, tilts immediately into the position which is shown in FIG. 6. The main valve body 3 is thus freed and, on account of its own weight, drops immediately onto the valve seat 13, as a result of which the main valve V is closed. The auxiliary valve body 7 is unlocked prematurely and drops downwards, likewise on account of its weight, and thus closes the first auxiliary valve HV1. it is thus possible to use the slide 76 to regulate the full quantity during flushing. The full quantity may be set, for example, to six liters or nine liters. This involves a preliminary setting which is not usually changed once the flushing cistern 1 has been installed. The flushing cistern 1 is thus installed for full flushing with, for example, nine liters or for full flushing with six liters.

The functioning of the discharge valve 10 according to the invention is explained in more detail hereinbelow.

Prior to flushing being triggered, the flushing cistern 1 is filled with flushing water 66 according to FIG. 2. The float 69 is raised by virtue of the buoyancy of the water. The main valve body 3 is subjected to loading by the water 66 in the closed position. The relief chamber 4 is likewise filled with water, which likewise bears on the main valve body 3.

In order to trigger partial flushing with, for example, three liters of water, the connecting rod 41 is raised in the direction of the arrow 43. The comparatively small force for raising the connecting rod 41 can be effected by hand or by a motor (not shown). By virtue of the connecting rod 41 being raised, the auxiliary valve body 7 is raised and, finally, in the raised position according to FIG. 3, the first catch 8 is pivoted by a pivoting movement of the second catch 9. The auxiliary valve body 7 is thus locked with the main valve body 3 and, at the same time, the locking of the main valve body 3 in relation to the valve housing 2 is released. In the case of the abovementioned operation of raising the auxiliary valve body 7, the first auxiliary valve HV1 is opened and, immediately after this, with the same displacement action, the second auxiliary valve HV2 is closed. Once the first auxiliary valve HV1 has been opened, then, according to FIG. 3, water flows downwards, in the direction of the arrow 47, out of the relief chamber 4 into the outlet connector 12. This produces a differential pressure at the main valve body 3, which is moved upwards into the position which is shown in FIG. 4. The main valve V is thus opened and the water 66, according to FIG. 4, flows through the openings 15, in the direction of the arrows 48, out of the flushing cistern 1 into the WC bowl.

When the main valve body 3 is raised, it is accompanied, at the same time, by the auxiliary valve body 7, since the latter, as has been mentioned, is locked with the main valve body 3 by the second catch 9. Since the flushing water 66 flows out of the flushing cistern 1, the water surface 46 drops correspondingly. If this water surface 46 reaches the float 69, then the buoyancy of the float 69 subsequently decreases and the float correspondingly descends downwards. Finally, the protuberance 31 pushes on the second catch 9 and pivots it in the clockwise direction into the position which is shown in FIG. 5. The protuberance 30 then butts against the first catch 8 and pushes the same against the ribs 71 and 71'. The auxiliary valve body 7 is now unlocked and, on account of its own weight, drops immediately onto the valve seat 18. The first auxiliary valve HV1 is thus closed. Through a top opening 45 of the channel 6, flushing water 66 flows from above, according to FIG. 5, in the direction of the arrow 49 into the control opening 20 and, finally, into the relief chamber 4. This water bears on the main valve body 3, which thus immediately drops downwards onto the valve seat 13. The main valve V is thus closed. The flushing cistern 1, however, has only been partially emptied since the water surface 46 has only dropped approximately into the region of the float 69. There are thus, for example, still six liters of flushing water remaining in the flushing cistern 1. If the main valve body 3 is located on the valve seat 13, then the auxiliary valve body 7 is thus also located in the bottom position, which is shown in FIG. 2. The pressure of the float 69 on the first catch 8 pivots this catch 8 again into the position which is shown in FIG. 2, and in which the main valve body 3 is locked with the valve housing 2. The action of the water surface 46 dropping causes a conventional inlet valve (not shown here) to open and flushing water thus flows into the flushing cistern 1 and the latter, finally, is refilled until the water surface 46 reaches approximately the level which is shown in FIG. 2. The flushing cistern 1 is thus once again in the starting position, which is shown in FIG. 2, and is consequently ready for further flushing.

In order to trigger full flushing, the second connecting rod 60, according to FIG. 6, is raised in the direction of the arrow 63. Flushing is thus triggered as has been explained above, since, in this case too, the auxiliary valve body 7 is raised and, consequently, the first auxiliary valve HV1 is opened and the second auxiliary valve HV2 is closed. Approximately at the same time, however, the float 50 is unlocked, and then tilts, in FIG. 6, in the clockwise direction about the axis of the rotary articulation 53. If the main valve body 3 has been raised by the displacement action H2 (FIG. 6), the float 50 tilts further in the same direction of rotation and the nose 51, finally, engages in the recess 64, as is shown in FIG. 7. The main valve body 3 is then locked with the valve housing 2. As in the case of partial flushing, the float 69, which descends once flushing has been triggered, closes the auxiliary valve HV1 but remains ineffective and cannot interrupt the flushing. If the slide 76 has been raised and the opening 75 is thus free, then, as has been explained above, the float 50, prior to the flushing cistern 1 being emptied completely, is pivoted once again into the position which is shown in FIG. 6 and the locking of the main valve body 3 is released and the flushing is thus interrupted. In this case, full flushing is likewise carried out, albeit only with six, instead of for example nine, liters of flushing water 66.

LIST OF DESIGNATIONS

1 Flushing cistern
2 Valve housing
2*a* Valve-housing part
3 Main valve body
4 Relief chamber
5 Valve opening
6 Channel (valve opening)
7 Auxiliary valve body
8 First catch
9 Second catch
10 Discharge valve
11 Flushing-cistern base
12 Outlet connector
13 Valve seat
14 Valve disc
15 Opening
16 Piston ring
17 Inner side
18 Valve seat
19 Valve disc
20 Control opening
21 Valve seat
22 Overflow channel
23 Rod
24 Stopping protuberance
25 Housing
26 Air chamber
27 Water chamber
28 Arrow
29 Arrow
30 Protuberance
31 Protuberance
32 Base wall
33 Protuberance
34 Periphery
35 Arm
36 Shoulder
37 Rotary articulation
38 Rotary articulation
39 Arm
40 Driver
41 Connecting rod
42 Slot
43 Arrow
44 Top side
45 Opening
46 Water surface
47 Arrow
48 Arrow
49 Arrow
50 Float
51 Nose
52 Stopping protuberance
53 Rotary articulation
54 Double arrow
55 Air chamber
56 Arrow
57 Base wall
58 Water chamber

59 Arrow
60 Second connecting rod
61 Slot
62 Driver
63 Arrow
64 Recess
65 Double arrow
66 Flushing water
67 Tube
68 Opening
69 Float
70 Chamber
71 Rib
72 Periphery
73 Chamber
74 Tongue
75 Opening
76 Slide
77 Double arrow
H1 Displacement action
H2 Displacement action
H3 Displacement action
HV1 First auxiliary valve
HV2 Second auxiliary valve
V Main valve

The invention claimed is:

1. Discharge valve for a flushing cistern, having a main valve which, in a valve housing has a main valve body which forms a piston above which a relief chamber is arranged, having a first auxiliary valve, by means of which the relief chamber can be emptied, at least in part, in order to trigger flushing, and having a second auxiliary valve, by means of which the relief chamber can be flooded in order to interrupt flushing, wherein the first auxiliary valve and the second auxiliary valve have a common movable auxiliary valve body which, when flushing is triggered, releases the valve opening of the first auxiliary valve and closes the valve opening of the second auxiliary valve with one displacement action.

2. Discharge valve according to claim 1, characterized in that a valve seat of the first auxiliary valve and a valve seat of the second auxiliary valve are arranged on the main valve body.

3. Discharge valve according to claim 1, characterized in that the auxiliary valve body can be moved vertically upwards with one displacement action in order to open the first auxiliary valve and to close the second auxiliary valve.

4. Discharge valve according to claim 1, characterized in that a valve opening of the first auxiliary valve and a valve opening of the second auxiliary valve are arranged one above the other.

5. Discharge valve according to claim 1, characterized in that the main valve body, in a starting position, can be locked in a releasable manner with the valve housing by a first catch.

6. Discharge valve according to claim 5, characterized in that a second catch is arranged on the auxiliary valve body, it being possible for this second catch, when the auxiliary valve body is raised, to pivot the first catch in order to unlock the main valve body from the valve housing.

7. Discharge valve according to claim 6, characterized in that the second catch interacts with a float which releases the auxiliary valve body, once partial flushing has been triggered, when a predetermined flushing water level is reached.

8. Discharge valve according to claim 1, characterized in that the first auxiliary valve and the second auxiliary valve are arranged in the interior of the main valve body.

9. Discharge valve according to claim 1, characterized in that the valve housing contains a further chamber, which contains a float which is mounted for tilting action on the valve housing.

10. Discharge valve according to claim 9, characterized in that the float can be unlocked in order to trigger full flushing, whereupon this float locks the main valve body in the raised state with the valve housing.

11. Discharge valve according to claim 9, characterized in that the abovementioned further chamber has an outlet opening which can be closed by a slide.

* * * * *